US007090585B2

(12) United States Patent
Forrester et al.

(10) Patent No.: US 7,090,585 B2
(45) Date of Patent: Aug. 15, 2006

(54) NAIL MANUFACTURING TOOL HOLDER HAVING A QUICK CHANGE MECHANISM

(75) Inventors: Gregory P. Forrester, Marion, IN (US); William H. Pierce, Rogers, AR (US); Joe L. Hurst, Rogers, AR (US)

(73) Assignee: Kennametal Inc., Latrobe, PA (US)

( * ) Notice: Subject to any disclaimer, the term of this patent is extended or adjusted under 35 U.S.C. 154(b) by 385 days.

(21) Appl. No.: 10/789,896

(22) Filed: Feb. 27, 2004

(65) Prior Publication Data

US 2005/0188741 A1 Sep. 1, 2005

(51) Int. Cl.
*B21G 3/00* (2006.01)

(52) U.S. Cl. ..... 470/125; 470/146; 470/192; 470/195

(58) Field of Classification Search ..... 470/121, 470/125, 127, 141, 144, 146, 192, 195; 407/66, 407/107, 108, 113; 72/465.1, 481.3, 481.5, 72/481.6, 481.7

See application file for complete search history.

(56) References Cited

U.S. PATENT DOCUMENTS

| | | | | |
|---|---|---|---|---|
| RE7,461 | E | 1/1877 | Zottman | |
| 3,545,060 | A | 12/1970 | Kerzran | |
| 4,552,491 | A | 11/1985 | Parker | |
| 5,536,119 | A | 7/1996 | Werner et al. | |
| 5,921,724 | A * | 7/1999 | Erickson et al. | 407/117 |
| 5,979,216 | A | 11/1999 | Schretter et al. | |
| 6,050,751 | A | 4/2000 | Hellstrom | |
| 6,152,658 | A | 11/2000 | Satran et al. | |
| 6,261,032 | B1 * | 7/2001 | Duwe et al. | 407/110 |
| 6,780,116 | B1 * | 8/2004 | Hurst et al. | 470/156 |
| 6,786,828 | B1 * | 9/2004 | Sørensen | 470/192 |
| 6,974,283 | B1 * | 12/2005 | Oettle | 407/107 |
| 2003/0032489 | A1 | 2/2003 | Hurst et al. | |
| 2003/0196473 | A1 | 10/2003 | Sorensen | |

FOREIGN PATENT DOCUMENTS

| | | | |
|---|---|---|---|
| EP | 0406202 | A2 * | 1/1991 |

* cited by examiner

*Primary Examiner*—Ed Tolan
(74) *Attorney, Agent, or Firm*—Matthew W. Smith

(57) ABSTRACT

A clamping jaw for gripping wire stock used in nail production machines includes a quick change system that allows efficient replacement of a removable tool insert. The clamping jaw includes a main body that is partially split so as to define a gap between first and second opposing clamping fingers having a recess portion there between for receiving and retaining the insert. The main body includes a top surface, a bottom surface, a central bore that extends between the first and second surfaces, and a countersunk cavity formed in the bottom surface. A tapered projection formed from the first and second clamping fingers extends into the countersunk cavity. A clamping member, having a tapered recess for receiving the projection, is positioned in the countersunk cavity. A fastener is tightened to draw the clamping member onto the projection to close the clamping fingers in order to grip the insert.

20 Claims, 4 Drawing Sheets

NAIL MANUFACTURING TOOL HOLDER HAVING A QUICK CHANGE MECHANISM

BACKGROUND OF THE INVENTION

1. Field of the Invention

The present invention pertains to the art of tool holders used in machines for the production of nails and, more particularly, to a quick change mechanism that enables replacement of an insert in the tool holder without requiring removal of the tool holder from the machine.

2. Discussion of the Prior Art

Nails are generally produced by feeding wire stock into a clamping punch and cutter. Clamping jaws hold the wire stock in position between opposing clamping surfaces while the cutter forms a pointed end of the nail and the clamping punch forms a head portion of the nail. Currently, nail manufacturing machines incorporate reciprocating clamping jaws that can produce in the order to 600 nails per minute. The clamping jaws are typically subjected to tremendous forces during the manufacturing process. Over time, the forces applied to the clamping jaws result in wear to the clamping surfaces. Once the clamping surfaces become worn, the wire stock is no longer held in a manner that enables the proper operation of the clamping punch and cutter.

In recognition of this problem, the clamping surfaces are typically defined by removable inserts. The removable inserts are positioned at end portions of the clamping jaws to grip the wire stock and are subjected to the same forces that were previously applied directly to the clamping surfaces. Thus, once the removable inserts become worn, they can be replaced with new inserts. In this manner, the manufacturer can save the costs associated with replacing entire clamping jaws. The prior art contains various examples of clamping jaws having removable inserts.

Two common types of clamping jaws incorporating removable inserts include wedge type and pinch type clamping jaws. In general, wedge type clamping jaws force the removable insert against a front portion of the clamping jaw through the use of a wedge block. The wedge block is accessible from a top portion of the clamping jaw and thus does not require that the entire clamping jaw be removed from the machine when replacing inserts. Pinch type clamping jaws employ a screw or other device, positioned in a side portion of the clamping jaw, to draw two clamping fingers, which are spaced by a longitudinal gap, together to hold the insert. Unfortunately, the screw is not accessible without removing the clamping jaw from the machine. While removing the clamping jaw is not a time consuming process, the replacement of inserts results in costly down time. Therefore, any time that can be eliminated from the replacement process would be a considerable benefit to a manufacturer.

Based on the above, there exists a need in the art for a more efficient method of clamping a removable insert in a pinch type clamping jaw. More specifically, there exists a need in the art for a quick change clamping jaw that allows removal and replacement of a tool insert in a pinch type clamping jaw without requiring the clamping jaw itself to be detached from the nail producing machine.

SUMMARY OF THE INVENTION

The present invention is directed to a clamping jaw used for gripping wire stock for a nail production machine. The clamping jaw includes a main body that is partially split so as to define a longitudinal gap. The presence of the gap forms first and second, opposing clamping fingers which collectively define a recess portion adapted to receive a removable tool insert. In accordance with the invention, the main body includes a first or top surface, an opposing, second or bottom surface, and a central bore that extends between the first and second surfaces, while bisecting the gap.

In accordance with a preferred form of the invention, the clamping jaw includes a countersunk cavity formed in the bottom surface. Arranged within the countersunk cavity is a tapered projection, a portion of which extends from each of the first and second clamping fingers. In the most preferred form of the invention, the tapered projection defines a frusto-conical member. A clamping element is positioned onto the tapered projection in the countersunk cavity. The clamping element is provided with a tapered recess that substantially corresponds to the contours of the tapered projection. A fastener is inserted into the central bore from the first surface so as to engage with the clamping element in the countersunk cavity. With tightening of the fastener, the clamping element is drawn onto the tapered projection to cause the first and second clamping fingers to come together, thereby gripping the removable insert. When the insert becomes worn, the fastener is loosened to release the insert from between the clamping fingers. In this manner, the insert can be readily replaced without requiring removal of the overall clamping jaw.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
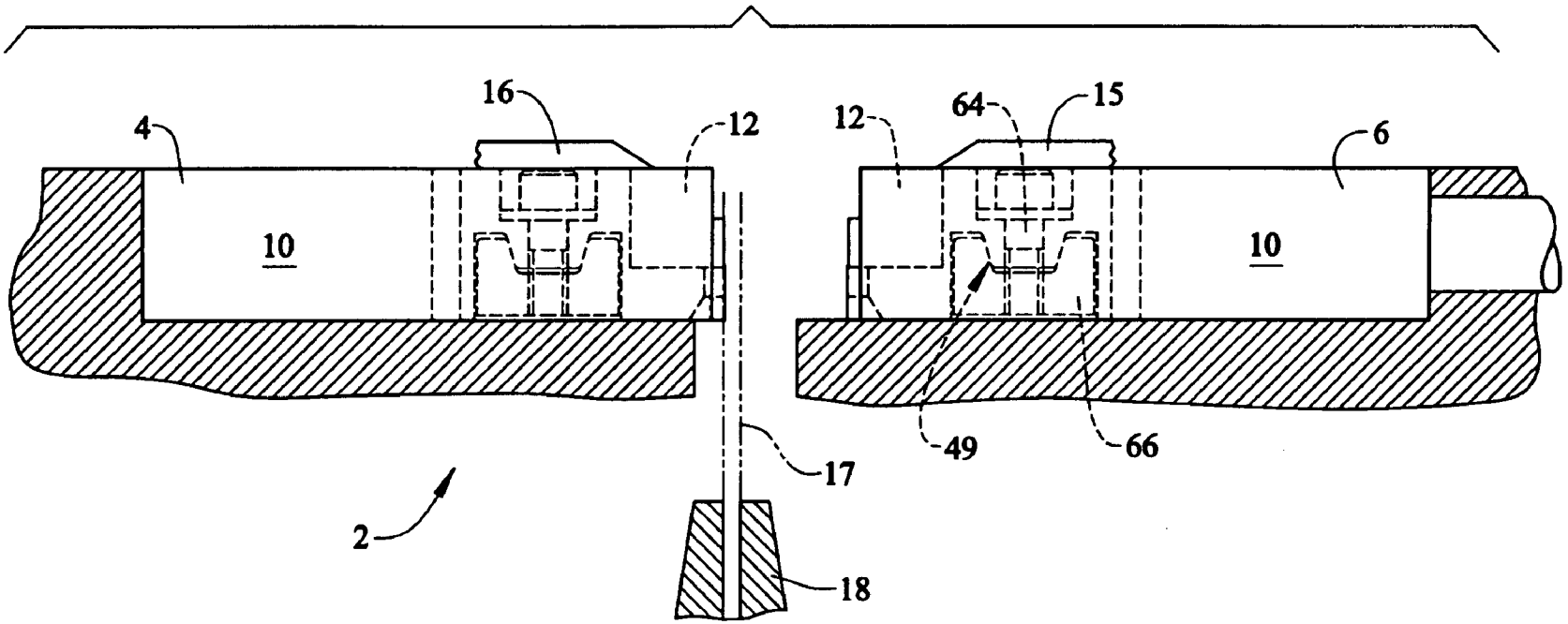
FIG. 1 is a partial side view of a die assembly used in the production of nails formed from wire stock.
Figure 2:
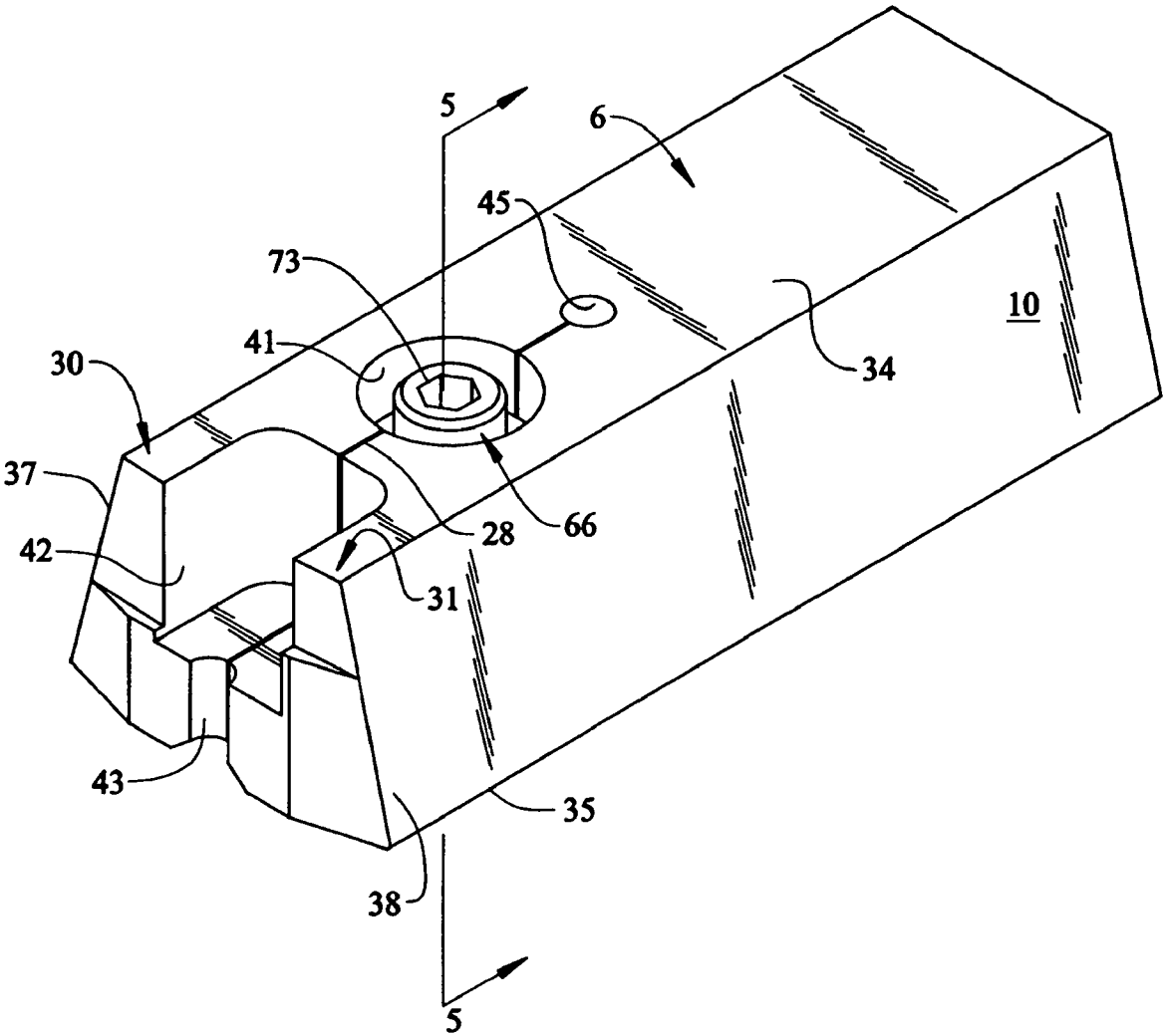
FIG. 2 is a perspective view of a clamping jaw portion of the die assembly of FIG. 1 having a tool insert clamping assembly constructed in accordance with the present invention.

With initial reference to FIG. 1, a clamping jaw assembly of an overall nail production machine is generally indicated at 2. As shown, clamping jaw assembly 2 includes a fixed elongated die or clamping jaw 4 arranged juxtaposed a movable die or clamping jaw 6. As each clamping jaw 4, 6 is similarly constructed, a detailed description of clamping jaw 6 will be made with an understanding that clamping jaw 4 has corresponding structure. Clamping jaw 6 includes a main body portion 10 having secured therein a removable tool insert 12. Positioned atop main body 10 is a cutter die 15 that is urged toward an opposing cutter die 16 associated with clamping jaw 4. In the production of nails, wire stock, indicated generally at 17, is fed upward through a conventional wire feeder 18 to a point between clamping jaws 4 and 6. At this point, movable clamping jaw 6 is urged toward fixed clamping jaw 4 to hold wire stock 17 in place against inserts 12. Once fixedly retained, the wire stock is cut through cutter dies 15 and a head is formed through the use of additional structure (not shown) to complete the manufacturing of a nail. In any event, over time, inserts 12 become worn, requiring replacement in order to continue the overall nail production process. Toward that end, inserts 12 are readily detached or removably retained within each clamping jaw 4 and 6 as will be discussed more fully below.

As best shown in FIGS. 2–5, clamping jaw 6 is partially split in a longitudinal direction so as to define a gap 28 that forms first and second clamping fingers 30 and 31. As will be discussed more fully below, clamping fingers 30 and 31 are drawn toward each other so as to grip or retain insert 12. More specifically, main body 10 includes a top surface 34, a bottom surface 35 and opposing side surfaces 37 and 38. In accordance with the invention, a central bore 40 extends between top surface 34 and bottom surface 35, with gap 28 bisecting central bore 40. As further shown in these drawings, a countersunk pocket 41 is arranged about central bore 40 at top surface 34. Additionally, main body portion 10 includes a recess portion 42 formed between first and second clamping fingers 30 and 31 for receiving and positioning insert 12. An arcuate portion 43 is formed on first and second clamping fingers 30 and 31 that aids in guiding and positioning wire stock 17.

Figure 5:
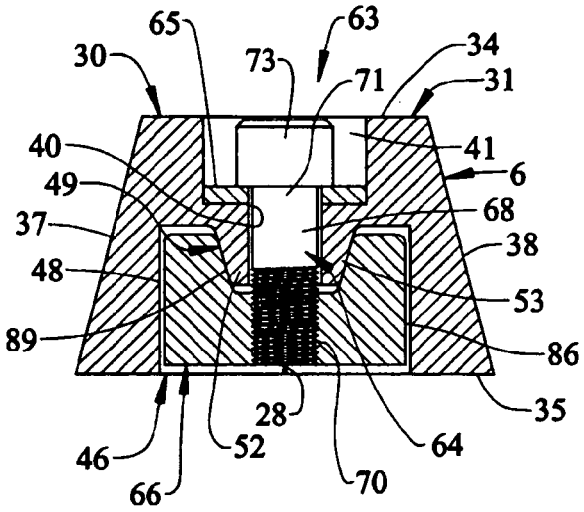
FIG. 5 is a cross-sectional view taken through the clamping jaw of FIG. 2.

As clearly shown in the drawings, gap 28 does not extend the entire length of main body portion 10. Instead, a strain relief opening or bore 45 is formed in main body portion 10 beyond countersunk pocket 41. Most preferably, strain relief opening 45 extends between top surface 34 and bottom surface 35 at a terminal end portion (not separately labeled) of gap 28. As best shown in FIG. 5, main body portion 10 also includes a countersunk cavity 46 provided at bottom surface 35. In accordance with a preferred form of the present invention, countersunk cavity 46 includes a peripheral side wall 48 having a substantially uniform cross-section and a central, tapered projection 49 including a first section 52 extending from first clamping finger 30 and a second section 53 that projects from second clamping finger 31. In accordance with the most preferred form of the present invention, tapered projection 49 is constituted by a frusto-conical wedge member that is split along gap 28.

Figure 3:
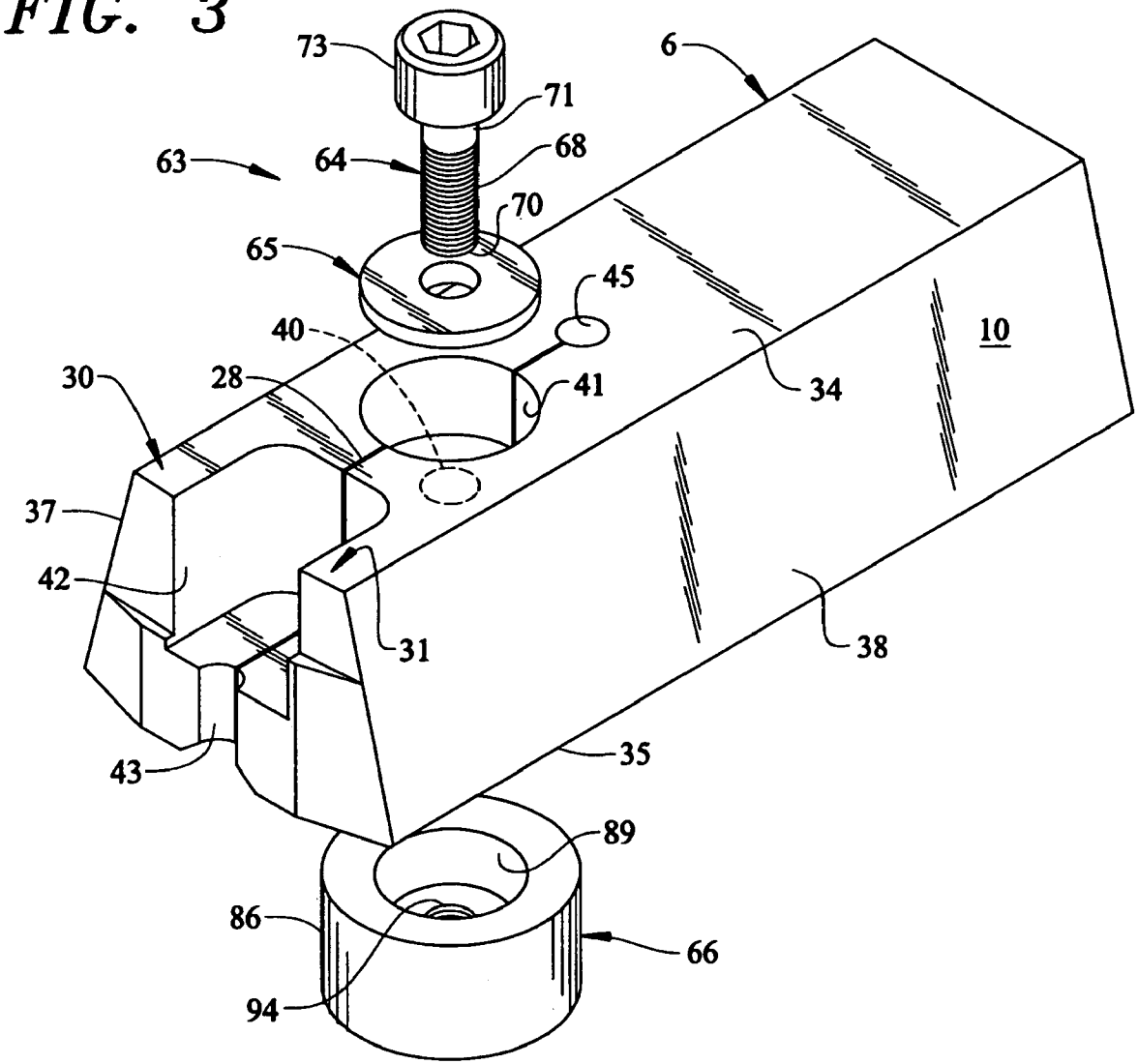
FIG. 3 is an exploded view of the clamping jaw portion of FIG. 2.
Figure 4:
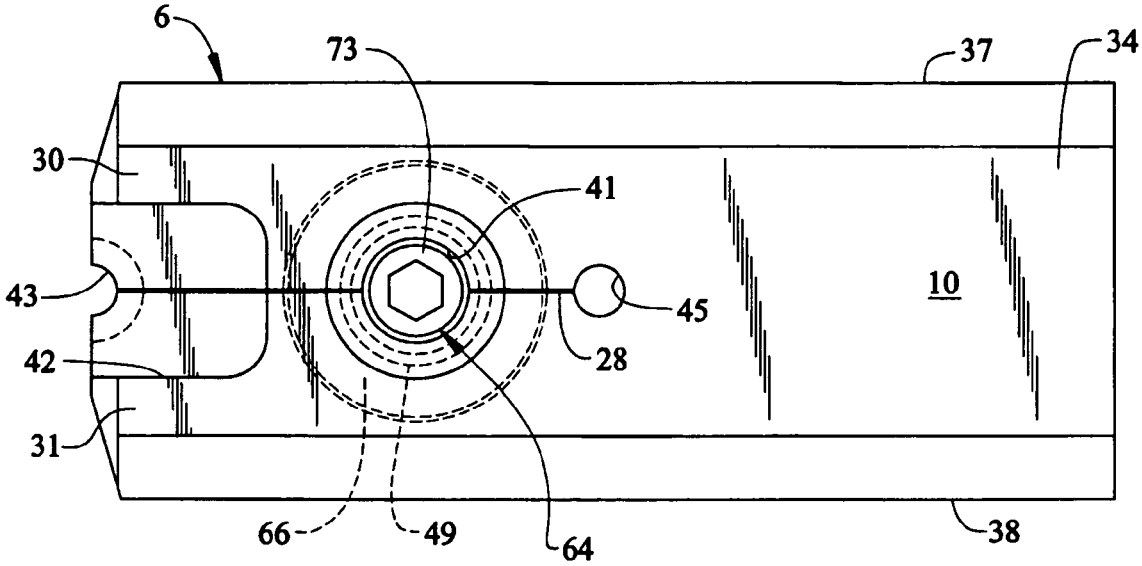
FIG. 4 is a top plan view of the clamping jaw portion of FIG. 2.

In order to draw first and second clamping fingers 30 and 31 together to removably retain insert 12 in recess portion 42, clamping jaw 6 is provided with a clamping assembly 63. As best shown in FIGS. 3 and 5, clamping assembly 63 includes a fastener 64, a washer 65 and a clamping element 66. Fastener 64 includes a shaft 68 having a threaded, first end 70 that extends to a second end 71. Second end 71 terminates in a head portion 73 of fastener 64. In the embodiment shown, fastener 64 is constituted by a cap or socket head screw of a type commonly found in the art. However, it should be understood that a wide variety of fasteners could be used. In any case, fastener 64 is inserted through washer 65 and then into central bore 40 such that first end 70 extends beyond tapered projection 49 into countersunk cavity 46. At this point, fastener 64 threadably interengages with clamping element 66. Clamping element 66 includes an outer, substantially uniform cylindrical shape adapted to fit within countersunk cavity 46 and a central, tapered recess or depression 89 that receives first and second sections 52 and 53 of tapered projection 49. More specifically, tapered depression 89 has a frusto-conical cross-section that corresponds to the shape of tapered projection 49.

With this arrangement, fastener 64 is threaded into a central, threaded passage 94 provided within clamping element 66 and rotated so as to wedge clamping member 66 onto tapered projection 49 of main body 10. More specifically, rotation of fastener 64 causes clamping element 66 to be drawn upward onto tapered projection 49. Continued rotation of fastener 64 causes first and second clamping fingers 30 and 31 to move toward one another, closing gap 28. Therefore, as clamping element 66 moves upward onto tapered projection 49, tapered depression 89 is drawn along first and second sections 52 and 53 so as to cause first and second clamping fingers 30 and 31 to be forced together so as to fixedly retain insert 12 within recess portion 42.

As fastener 64 is accessible from top surface 34, insert 12 can be removed and replaced within a respective one of clamping jaws 4 and 6 without requiring main body portion 10 to be physically removed from the nail production machine. That is, by enabling fastener 64 to be accessed from atop the respective clamping jaw 4, 6 and providing for the frusto-conical wedge action between projection 49 and clamping element 66 within main body portion 10, a technician can readily replace each insert 12 with minimal down time to the overall nail production process.

Although described with reference to a preferred embodiment of the present invention, it should be readily apparent to one of ordinary skill in the art that various changes and/or modifications can be made to the invention without departing from the spirit thereof. In general, the invention is only intended to be limited to the scope of the following claims.

We claim:

1. A clamping jaw used for gripping wire to form nails comprising:

a main body split partially in a longitudinal direction so as to define a gap between first and second clamping fingers, said main body including a top surface, a bottom surface, a central bore extending between the top and bottom surfaces and bisected by the gap, a recess portion defined between the first and second clamping fingers adapted to receive a removable insert, a countersunk cavity formed in the bottom surface, and a projection provided at the central bore, said projection including a first section extending from the first clamping finger and a second section extending from the second clamping finger;

a fastener having a shaft extending through the central bore, said shaft including a first end that extends beyond the projection leading to a second end that terminates in a head member; and a clamping element positioned in the countersunk cavity, said clamping element including a recess, wherein the first end of the fastener engages the clamping element, with the fastener being adapted to wedge the recess against the projection of the countersunk cavity to draw the first and second clamping fingers toward each other, thereby causing the gap in the main body to become smaller.

2. The clamping jaw according to claim 1, wherein the projection is frusto-conical in shape and extends about the central bore in the countersunk cavity.

3. The clamping jaw according to claim 1, wherein clamping member includes a central, threaded passage receiving the fastener, said recess being formed about the threaded passage.

4. The clamping jaw according to claim 1, further comprising: a countersunk pocket formed in the top surface about the central bore, said countersunk pocket receiving the head member of the fastener.

5. The clamping jaw according to claim 1, further comprising: a removable tool insert nested in the recess portion of the main body, wherein drawing the clamping element into the countersunk cavity causes the removable tool insert to be gripped by the first and second clamping fingers.

6. The clamping jaw according to claim 1, further comprising: a stress relief extending between the first and second surfaces of the main body at a terminal end portion of the gap.

7. A clamping jaw used for gripping wire to form nails comprising:

a main body split partially in a longitudinal direction so as to define a gap between first and second clamping fingers, said main body including a top surface, a bottom surface, a central bore extending between the top and bottom surfaces and bisected by the gap, a recess portion defined between the first and second clamping fingers, and a countersunk cavity formed in the bottom surface having a substantially uniform cross-section;

a removable tool insert nested in the recess portion;

a projection provided at the central bore, said projection including a first section extending from the first clamping finger and a second section extending from the second clamping finger; and means for clamping the insert between the first and second clamping fingers, said clamping means engaging the first and second sections of the projection to draw the first and second clamping fingers together so as to selectively retain the insert in the recess portion of the main body.

8. The clamping jaw according to claim 7, wherein the projection is constituted by a frusto-conical member extending about the central bore in the countersunk cavity.

9. The clamping jaw according to claim 8, wherein the clamping means includes a frusto-conical recess adapted to receive the frusto-conical member, wherein drawing the clamping means onto the frusto-conical member causes the first and second clamping fingers to come together.

10. The clamping jaw according to claim 7, further comprising: a stress relief extending between the first and second surfaces of the main body at a terminal end portion of the gap.

11. The clamping jaw according to claim 7, further comprising: a countersunk pocket formed in the top surface of the main body about the central bore.

12. A nail production machine comprising:

a wire feeding unit;

first and second clamping jaws for selectively gripping wire fed by the wire feeding unit during the formation of nails, each of the first and second clamping jaws including:

a main body split partially in a longitudinal direction so as to define a gap between first and second clamping fingers, said main body including a top surface, a bottom surface, a central bore extending between the top and bottom surfaces and bisected by the gap, a recess portion defined between the first and second clamping fingers adapted to receive a removable insert, a countersunk cavity formed in the bottom surface, and a projection provided at the central bore, said projection including a first section extending from the first clamping finger and a second section extending from the second clamping finger;

a fastener having a shaft extending through the central bore, said shaft including a first end that extends beyond the projection leading to a second end that terminates in a head member; and a clamping element positioned in the countersunk cavity, said clamping element including a recess, wherein the first end of the fastener engages the clamping element, with the fastener being adapted to wedge the recess against the projection of the countersunk cavity to draw the first and second clamping fingers toward each other, thereby causing the gap in the main body to become smaller;

a replaceable insert nested in the recess portion of each of the first and second clamping jaws and gripped by the first and second clamping fingers; and at least one cutter die for cutting nail sections from wire fed from the wire feeding unit and gripped by the first and second clamping jaws.

13. The nail production machine according to claim 12, wherein the projection of each of the first and second clamping jaws is frusto-conical in shape and extends about the central bore in the countersunk cavity.

14. The nail production machine according to claim 12, wherein each of the first and second clamping members includes a central, threaded passage receiving the fastener, said recess being formed about the threaded passage.

15. A method of clamping a removable tool insert in a tool holder including a main body which is partially split in a longitudinal direction so as to define a gap forming first and second clamping fingers comprising:

positioning the removable insert into a recess formed between the first and second clamping fingers; and drawing a clamping member into a countersunk cavity formed in the main body to cause the clamping member to wedge against projection portions extending from each of the first and second clamping fingers in order to reduce the gap, thereby clamping the removable insert between the first and second finger members.

16. The method according to claim 15, wherein the clamping member is drawn into the countersunk cavity by tightening a fastener extending through the main body and into the clamping member.

17. The method according to claim 16, wherein tightening of the fastener causes the fastener to thread into a passage formed in the clamping member to draw the clamping member against the projection portions.

18. The method according to claim 17, wherein tightening of the fastener causes a head of the fastener to be positioned in a countersunk pocket formed in a top surface of the main body.

19. The method according to claim 15, wherein the clamping member is drawn against the projection portions within the countersunk cavity formed in the main body.

20. The method according to claim 19, wherein the clamping member is wedged against the projection portions by causing a tapered recess formed in the clamping member to ride along tapered surfaces of the projection portions as the clamping member is draw into the countersunk cavity.

* * * * *